US009601097B2

(12) United States Patent
Nelson et al.

(10) Patent No.: US 9,601,097 B2
(45) Date of Patent: Mar. 21, 2017

(54) RELIABLE REAL-TIME TRANSMISSION OF MUSICAL SOUND CONTROL DATA OVER WIRELESS NETWORKS

(71) Applicant: Zivix, LLC, Minneapolis, MN (US)

(72) Inventors: Jason Robert Nelson, St. Louis Park, MN (US); Allen James Heidorn, Watertown, MN (US); Robert John Cox, Plymouth, MN (US)

(73) Assignee: Zivix, LLC, Minneapolis, MN (US)

( * ) Notice: Subject to any disclaimer, the term of this patent is extended or adjusted under 35 U.S.C. 154(b) by 0 days.

(21) Appl. No.: 14/640,823

(22) Filed: Mar. 6, 2015

(65) Prior Publication Data

US 2015/0255053 A1 Sep. 10, 2015

Related U.S. Application Data

(60) Provisional application No. 61/948,956, filed on Mar. 6, 2014.

(51) Int. Cl.
*G10H 1/00* (2006.01)
*G10H 7/00* (2006.01)

(52) U.S. Cl.
CPC ..... *G10H 1/0066* (2013.01); *G10H 1/00* (2013.01); *G10H 1/0083* (2013.01); *G10H 2240/205* (2013.01); *G10H 2240/305* (2013.01)

(58) Field of Classification Search
CPC ..... G10H 1/0066; G10H 1/0083; G10H 1/00
(Continued)

(56) References Cited

U.S. PATENT DOCUMENTS 4,942,551 A * 7/1990 Klappert ..... G09B 5/04 360/32
5,343,451 A * 8/1994 Iizuka ..... G11B 20/10527 369/30.19

(Continued)

OTHER PUBLICATIONS

"Identifying & Solving PC MIDI & Audio Timing Problems," PC Musician, SOS, http://www.soundonsound.com/sos/mar01/articles/pcmusciain.asp; retrieved Feb. 16, 2014, 4 pgs.

(Continued)

*Primary Examiner* — David Warren
*Assistant Examiner* — Christina Schreiber
(74) *Attorney, Agent, or Firm* — Christensen, Fonder, Dardi & Herbert PLLC

(57) ABSTRACT

A method of communicating musical sound control data over a wireless network that includes receiving a plurality of data commands formatted according to a MIDI protocol; assigning a packet sequence number to each of the data commands to form a plurality of historical data payload packets; storing the historical data payload packets in a buffer; receiving at a wireless interface device an acknowledgment message having a feedback sequence number; removing from the buffer selected historical payload packets of the plurality of stored historical data payload packets, each of the selected historical data payload packets having a packet sequence number that is the same as or less than the feedback sequence number, such that the buffer stores non-selected data commands, each of the non-selected data commands associated with a packet sequence number greater than the feedback sequence number; and transmitting the non-selected historical payload packets over a wireless network.

20 Claims, 12 Drawing Sheets

(58) Field of Classification Search
USPC ..... 84/645
See application file for complete search history.

(56) References Cited

U.S. PATENT DOCUMENTS

| | | | | | |
|---|---|---|---|---|---|
| 5,672,837 | A * | 9/1997 | Setoguchi | G10H 1/0008 | 84/609 |
| 5,768,350 | A * | 6/1998 | Venkatakrishnan | H04M 11/06 | 370/418 |
| 5,778,370 | A * | 7/1998 | Emerson | G06F 17/30289 | |
| 5,798,990 | A * | 8/1998 | Lokhoff | G11B 20/1217 | 369/124.07 |
| 5,860,119 | A * | 1/1999 | Dockser | G06F 5/10 | 710/52 |
| 5,974,387 | A * | 10/1999 | Kageyama | G10H 1/361 | 704/500 |
| 5,983,280 | A * | 11/1999 | Hunt | G06F 13/387 | 709/230 |
| 6,066,794 | A * | 5/2000 | Longo | G10H 1/02 | 84/600 |
| 6,191,349 | B1 * | 2/2001 | Flam | G10H 1/0066 | 84/609 |
| 6,232,541 | B1 * | 5/2001 | Kumagai | G10H 1/0066 | 84/645 |
| 6,574,243 | B2 * | 6/2003 | Tsunoda | G10H 1/0066 | 370/395.64 |
| 6,627,807 | B2 * | 9/2003 | Motoyama | G10H 1/0058 | 84/615 |
| 6,829,648 | B1 * | 12/2004 | Jones | H04L 29/06 | 370/327 |
| 7,396,993 | B2 * | 7/2008 | Tada | G10H 1/0066 | 714/4.1 |
| 8,317,614 | B2 * | 11/2012 | McCauley | A63F 13/06 | 463/36 |
| 8,375,277 | B2 * | 2/2013 | Koster | H04L 12/1868 | 370/390 |
| 2004/0154460 | A1 * | 8/2004 | Virolainen | G10H 1/0058 | 84/645 |
| 2004/0209629 | A1 * | 10/2004 | Virolainen | G10H 1/0066 | 455/466 |
| 2005/0002525 | A1 * | 1/2005 | Alkove | H04L 29/06 | 380/37 |
| 2005/0016363 | A1 * | 1/2005 | Puryear | G10H 1/0066 | 84/626 |
| 2005/0172790 | A1 * | 8/2005 | Tada | G10H 1/0066 | 84/645 |
| 2012/0057842 | A1 * | 3/2012 | Caligor | G10H 1/0058 | 386/201 |
| 2012/0174738 | A1 * | 7/2012 | Kim | G10H 1/0066 | 84/645 |
| 2015/0255053 | A1 * | 9/2015 | Nelson | G10H 1/0066 | 84/645 |

OTHER PUBLICATIONS

Lazzaro, John, et al., "An RPT Payload Format for MIDI," Audio Engineering Society Convention Paper, Presented Oct. 28-31, 2004, 16 pgs.

"MIDI Networking," Distributed Processing With Digital Performer, SOS, Mar. 2007, 4 pgs.

Lazzaro, John, et al., "Network Musical Performance," presented at NOSSDAV 2001 conference, http://www.cs.berkeley.edu/~lazzaro/nmp/index.html, retrieved Feb. 14, 2014, 2 pgs.

Lazzaro, J., et al., "RTP Payload Format for MIDI," Internet Engineering Task Force (IETF), Network Working Group, Request for Comments: 4696, Category: Standards Track, Nov. 2006, 117 pgs.

Lazzaro, J., et al., "An Implementation Guide for RTP MIDI," Internet Engineering Task Force (IETF), Network Working Group, Request for Comments: 4696, Category: Informational, Nov. 2006, 27 pgs.

Lazzaro, J., et al., "RTP Payload Format for MIDI," Internet Engineering Task Force (IETF), Request for Comments: 6295, Obsoletes: 4695, Category: Standards Track, Jun. 2011, 119 pgs.

Lazzaro, J., et al., "RTP MIDI: An RTP Payload Format for MIDI," presented at 117$^{th}$ AES convention, http://www.cs.berkeley.edu/~lazarro/rtpmidi/, retrieved Feb. 14, 2014.

Falquet, Nicolas, et al., "RTP MIDI: Recovery Journal Evaluation and Alternative Proposal," GRAME Laboratoire de Recherche en Informatique Musicale, Technical Report TR-050622, Jun. 2005, 17 pgs.

* cited by examiner

Jamstik generates ZR-WP natively, in response to picking and fretting action by the user.

```
+-------------------------------------
+ Main Packet Header                  + 4 bytes
+--------+--------+--------+--------+
+ Command-Specific Payload            + n bytes
+--------+--------+--------+--------+
```

```
+-------------------------------------
+ Main Packet Header          +
+--------+--------+--------+--------+
+ 'z'   + Command+ Feedback Seq#   + 32-bits
+--------+--------+--------+--------+
```

```
+-------------------------------------+
+ Device Name/Identifier               + 32 Bytes
+-------------------------------------+
+  ... ... ... .. .. .. .. .. .. .. .. .+
+-------------------------------------+
+ Flags                                 + 1 byte
+----+----+----+----+----+----+----+----+
+                                T    R  +
+-------------------------------------+
```

Flag Definitions:

T = The Device Can Transmit MIDI Data

R = The Device Can Receive MIDI Data

FIG. 10

```
+-----------------------------------------------+
+ New Payload Packet Header                      +
+-----------+-----------+-----------+-----------+
+ 0x7A ('z')+ 0x01(cmd) +  feedback sequence    +  32-bits
+-----------+-----------+-----------+-----------+
+ Historical Payload 0 (oldest unacknowledged)  +  n-bytes
+-----------+-----------+-----------+-----------+
+-----------+-----------+-----------+-----------+
+ ...                                            +
+ ...                                            +
+-----------+-----------+-----------+-----------+
+ Historical Payload n (newest)     +  n-bytes
+-----------+-----------+-----------+-----------+
+-----------+-----------+-----------+-----------+
+-----------+-----------+-----------+-----------+
+ ...                                            +
+-----------+-----------+-----------+-----------+
```

FIG. 11

```
+-----------+-----------+-----------+-----------+----------+
+PACKET SEQUENCE NUMBER     + LENGTH    +  3-bytes
+-----------+-----------+-----------+-----------+----------+
+ Data..... n                                          +
+-----------+-----------+-----------+-----------+----------+
```

FIG. 12

RELIABLE REAL-TIME TRANSMISSION OF MUSICAL SOUND CONTROL DATA OVER WIRELESS NETWORKS

RELATED APPLICATION

This application claims the benefit of U.S. Provisional Patent Application No. 61/948,956, filed Mar. 6, 2014, which is incorporated herein in by reference in its entirety.

FIELD OF THE INVENTION

The present invention is generally directed to reliable, real-time transmission of musical sound control data over wireless networks. More specifically, embodiments of the invention are directed to methods, systems and apparatuses for reliable real-time communication of Musical Instrument Digital Interface (MIDI) data over lossy wireless networks.

BACKGROUND OF THE INVENTION

Electronic musical instruments typically utilize Musical Instrument Digital Interface (MIDI) technology to communicate with other electronic musical instruments, music workstations, computers, and other such electronic devices. Such electronic musical instruments, referred to generally as MIDI devices, or MIDI controllers, generate digital musical sound control data which can be used to generate audio sounds, be recorded for later playback, or be transmitted to other devices. For example, MIDI data may be transmitted to devices such as a computer, including tablets, notebooks, and other mobile computers, operating software applications used for recording, editing and playing back digital audio.

MIDI standards, including the MIDI 1.0 standard, define physical layers and a command language of a protocol for communication between MIDI-capable devices. A stream of MIDI digital musical sound control data in the form of commands, may be streamed over a MIDI cable from a MIDI-sending device to a MIDI receiving-device, in accordance to the MIDI standard. Alternatively, MIDI data may be transmitted wirelessly from a sender to a receiver.

Wireless transmission of MIDI data over a lossy network poses unique challenges with respect to real-time transmission and generation of live music due to lost or delayed data. Generally, to minimize data loss when transmitting data over a wireless network, a "reliable" or connection-oriented transport protocol, such as TCP over IP may be used. However, use of TCP/IP inherently results in high latency or delays as lost or missing data are retransmitted over the network. For certain applications, high rates of latency are inconsequential. For example, when a MIDI device streams data to a workstation used to record the data stream, relatively long delays between generation of the data and recording of the data do not affect the recording quality. In such an instance, data quality may be the most important factor.

On the other hand, when a MIDI data stream generated by a musician playing a MIDI instrument is transmitted to a remote device that generates the sound represented by the data in real-time, transmission delays of more than 20 milliseconds may be noticed by a listener, including the musician playing the MIDI instrument, other collaborating musicians, and particularly, an audience. Therefore, for real-time generation of sound in wireless networks, MIDI data may be transmitted wirelessly based on "connection-less-oriented", or "best-efforts" protocols such as UDP/IP.

Such transmission avoids some of the high-latency problems created by retransmission of data and other characteristics of reliable transport protocols.

However, while connectionless protocols may reduce latency in some cases, the periodic loss of MIDI data packets during transmission creates other problems that affect the quality of the musical sounds generated by the remote device. For example, the loss of a command "Note Off", which commands that a note previously "turned on" via a "Note On" command be turned off, can result in a note being played or generated continuously, rather than lasting only a predetermined period of time.

In an attempt to address these types of problems, a transport protocol directed specifically to transmission of MIDI music control data has been developed. The RTP MIDI protocol, proposed by John Lazzaro and John Warzynek in 2004, and defined in the RFC 6295 standard adopted by the Internet Engineering Task Force (IEFT), utilizes the generic protocol for real-time applications, Real-Time Protocol (RTP), to transport MIDI data over connectionless-oriented networks, such as UDP/IP networks. Rather than relying on retransmission to augment missing data packets at a receiver, the RTP MIDI protocol utilizes a system of recovery journals to transmit data packet state information, along with current MIDI command data, allowing lost data packets to be reconstructed based on the state data at the receiver as needed.

However, while the RTP MIDI protocol improves the quality of received MIDI music control data transmitted over lossy wireless networks as compared to other protocols, periodic high latency, in combination with latency variation (jitter), still result in occasional unintended audible distortion of the music generated from the MIDI data stream.

SUMMARY OF THE INVENTION

Embodiments of the invention address the shortcomings of the prior art, including the RTP MIDI protocol, by introducing methods, systems, and apparatuses for transmission of musical sound control data, such as MIDI data, over wireless networks.

In an embodiment, the invention comprises a communications system that includes a sending device that efficiently packages and transmits musical sound control data over a wireless network according to a new real-time wireless protocol, herein referred to as "ZR-WP". The sending device may comprise a wireless interface device receiving musical sound control data, such as "raw" MIDI data, and transmitting ZR-WP data packets. Alternatively, the sending device may comprise a controller or device that generates native ZR-WP data packets. The ZR-WP packets are received and acknowledged by a receiving device, such as a tablet computer, for translation and use by a user application. By avoiding delays associated with retransmission of packets, latency and jitter are reduced, producing an improved sound quality, particularly for real-time playback of music.

More specifically, and as will be explained further below, embodiments of the invention reduce latency in a number of ways: first, known "journaling" systems used by the RTP MIDI protocol and that rely on transmission of state data to recover lost data packets, are replaced by more efficient systems and methods of transmitting historical payload data; second, systems and methods of the invention aggressively transmit current and historical data whenever MIDI data is available; third, the use of broadcast methods within the 802.11 wireless protocol prevents time-wasting retries; and fourth, embodiments of the invention send data packets even where there is no data so as to stop Wi-Fi-chip-based receivers from going to sleep.

In an embodiment, the ZR-WP protocol comprises a UDP-based (User Datagram Protocol) protocol that aims to simplify, streamline, and stabilize MIDI communication for the sending devices. The invention provides what other known MIDI-over-Ethernet protocols have failed to do for real-time MIDI transmission, particularly where minimal latency is critical. The invention provides this improved performance by: functioning aggressively over busy Wi-Fi networks; passing-through MIDI data (mostly verbatim) without reinterpreting and reformatting the data; and implementing aggressive timing practices that ensures that if packets are lost they are very quickly recovered. The simple implementation of the protocol means that it is easy to implement in many languages and platforms. Further, because the ZR-WP protocol is based on UDP, latency is not increased by network retries. In an embodiment, maximum latency does not exceed 25 ms; in another embodiment, maximum latency does not exceed 50 ms; in an embodiment, maximum latency ranges from 25-50 ms. Further, systems, methods and protocols of the invention may improve jitter. In an embodiment, maximum latency does not exceed 10 ms; in another embodiment, maximum jitter does not exceed 20 ms; in another embodiment, maximum jitter ranges from 10-20 ms.

Unlike known protocols for transmission of MIDI data over wireless networks, including RTP-MIDI, in an embodiment, methods of implementing the protocol of the invention include transmitting a sequence of previously-sent, unacknowledged MIDI commands within a single data packet. Such a process avoids delays created by requiring that a data acknowledgment messaged be received before data is re-transmitted. Rather, by building and transmitting packets that continually grow to include unacknowledged, previously-transmitted data payloads, the receiving unit can recover lost or missing data quickly, thereby reducing latency and improving real-time listening quality.

An embodiment includes a method of communicating musical sound control data over a wireless network, which comprises: receiving a data stream comprising a plurality of data commands formatted according to a MIDI protocol; assigning a packet sequence number to each of the plurality of data commands to form a plurality of historical data payload packets; storing the plurality of historical data payload packets in a buffer; receiving at a wireless interface device an acknowledgment message having a feedback sequence number; removing from the buffer selected historical payload packets of the plurality of stored historical data payload packets, each of the selected historical data payload packets having a packet sequence number that is the same as or less than the feedback sequence number, such that the buffer stores non-selected data commands, each of the non-selected data commands associated with a packet sequence number greater than the feedback sequence number; and transmitting the non-selected historical payload packets over a wireless network.

Another embodiment includes an interface device for transmitting musical sound control data over a wireless network, comprising: a communications port configured to receive musical sound control data, the control data including a plurality of data commands formatted according to a musical instrument digital interface (MIDI) protocol; a transceiver configured to receive an acknowledgment message having a feedback sequence number; a memory configured to store data; a processor in electrical communication with the transceiver and the memory. The processor is configured to implement the steps of: assigning a packet sequence number to each of the plurality of data commands to form a plurality of historical data payload packets; causing the plurality of historical data payload packets to be stored in the memory; removing from the memory selected historical payload packets of the plurality of stored historical data payload packets, each of the selected historical data payload packets having a packet sequence number that is the same as or less than the feedback sequence number, such that the memory stores non-selected data commands, each of the non-selected data commands associated with a packet sequence number greater than the feedback sequence number; and causing the transceiver to transmit the non-selected historical payload packets over a wireless network.

BRIEF DESCRIPTION OF THE FIGURES

The invention can be understood in consideration of the following detailed description of various embodiments of the invention in connection with the accompanying drawings, in which:

FIG. 10 is a diagram illustrating the format of a Device Available command, according to an embodiment of the invention;

FIG. 11 is a block diagram depicting a payload format, including new and historical payloads, of the data packet of FIG. 8, according to an embodiment of the invention;

FIG. 12 is a block diagram depicting an individual historical payload format of the payload format of FIG. 11, according to an embodiment of the invention;

Figure 1:
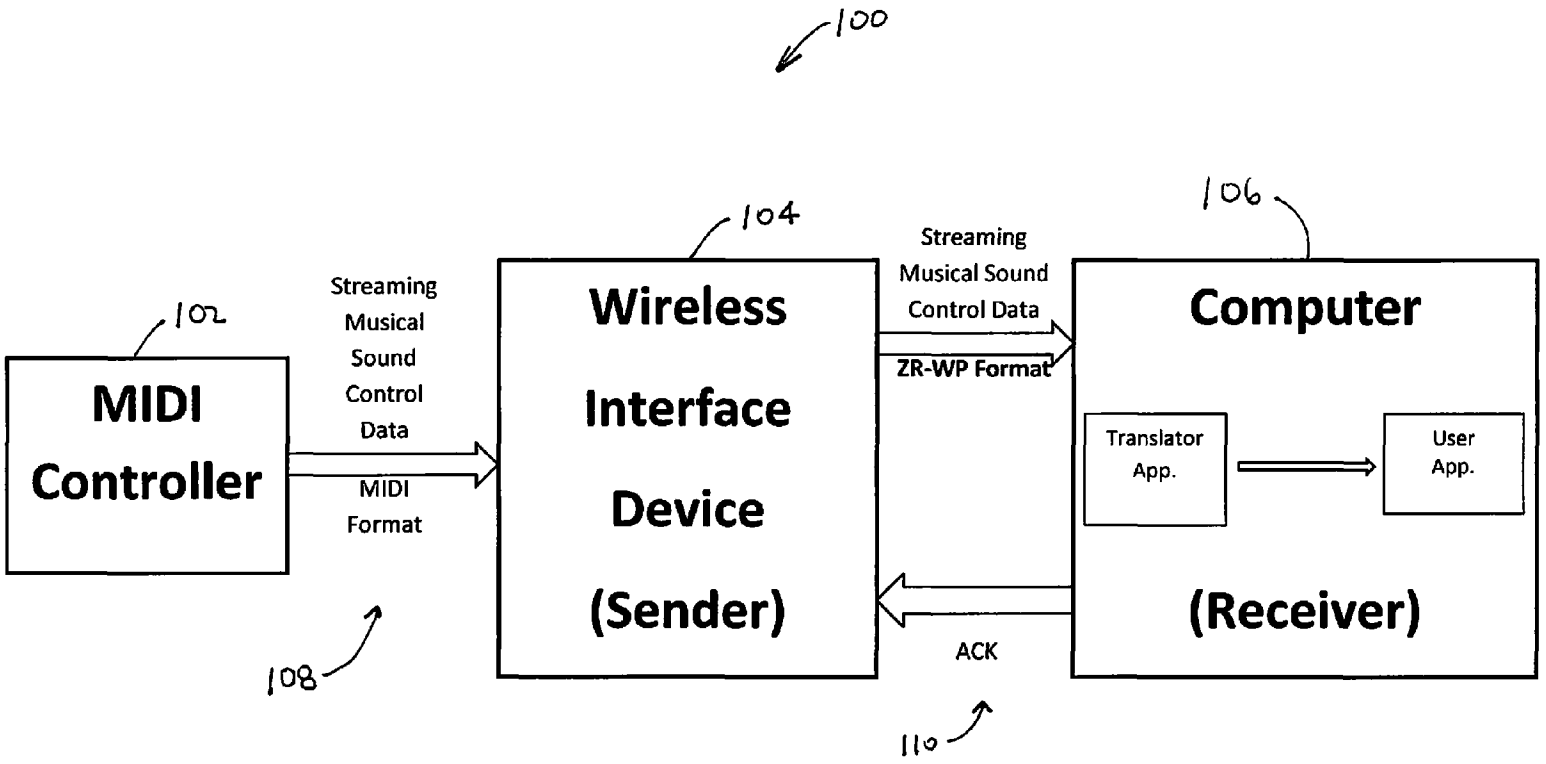
FIG. 1 is a block diagram of a musical sound control data communications system that includes a wireless interface device, according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Embodiments of the invention include systems, apparatuses and methods of communicating musical sound control data, such as MIDI data, over wireless networks. Embodiments of the invention further include a new network protocol for transport of real-time musical sound control data, including MIDI data, over connectionless networks. The new communications messaging protocol, or real-time wireless protocol is referred to herein as "ZR-WP", though it will be understood that in some embodiments, embodiments of the invention may not be restricted to simply MIDI-formatted data, but could include musical sound control data formatted according to other protocols.

Herein, MIDI technology refers to technology as detailed according to various known MIDI specifications, including MIDI 1.0, General MIDI, and other MIDI-related standards. The MIDI 1.0 standard is herein incorporated by reference in its entirety, including Version 96.1, Second Edition, published in November 2001.

Embodiments of communications systems and corresponding apparatuses are firstly depicted and described with respect to FIGS. 1-6, followed by an explanation of the embodiments of the new ZR-WP protocol and associated communication methods, as depicted and describe with respect to FIGS. 7-14.

Referring to FIG. 1, an embodiment of musical sound control data communications system 100 is depicted. In the depicted embodiment, musical sound control data communications system 100 includes controller 102, wireless interface device (sender) 104, and computer 106. Controller 102 communicates with wireless interface device 104 over a first network 108; wireless interface device 104 communicates with computer 106 over a second network 110.

In an embodiment, controller 102 comprises a Musical Instrument Digital Interface (MIDI) controller, such as a digital instrument incorporating MIDI technology, including a MIDI keyboard, stringed instrument, fretted instrument, and so on. In addition to instruments, MIDI controller 102 may comprise other controllers, devices, or sources capable of outputting digital musical sound control data. As understood by those skilled in the art, musical sound control data, including MIDI data, may be used to recreate musical sounds of the controller or instrument. Herein, controller 102 will be referred to as MIDI controller 102, though it will be understood that any variety of controllers, devices or sources as described above may be used.

Figure 2:
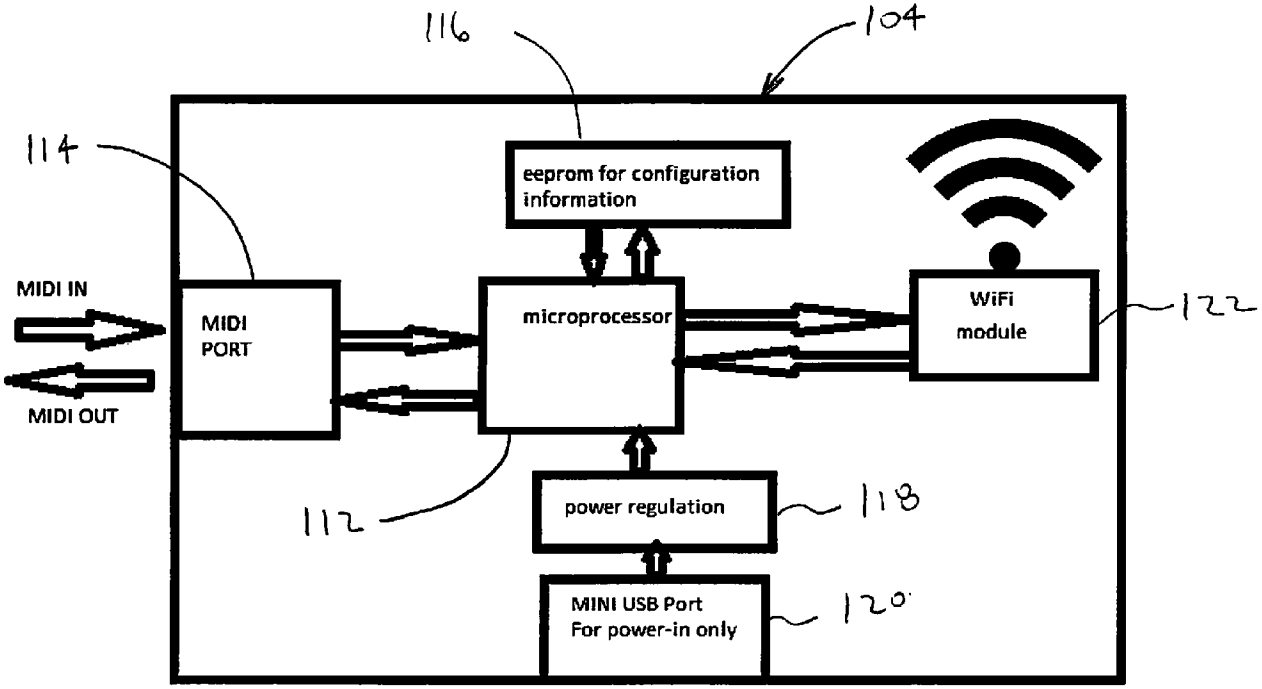
FIG. 2 is a block diagram of a wireless interface device, according to an embodiment of the invention.

Referring also to FIG. 2, an embodiment of wireless interface device 104 is depicted. In the depicted embodiment, wireless interface device 104 includes processor 112, communications port 114, memory 116, power regulation circuitry 118, optional power port 120, and communications module 122.

Processor 112 may comprise a microprocessor, microcontroller, microcomputer, CPU, or other such processing unit that may or may not include integrated memory.

Communications port 114, which in an embodiment comprises a MIDI port, is configured to receive musical sound control data, such as MIDI data. Communications port 114 is communicatively coupled to processor 112. In an embodiment, communications port 114 is configured to receive a communications cable, such as a MIDI cable. In other embodiments, communications port 114 comprises a module for receiving wireless communications.

Memory 116 may comprise any of a variety of known physical devices for storage and retrieval of data, software algorithms, and so on, relating to embodiments of the invention. As such, memory 116 may include volatile and/or non-volatile memory devices such as ROM, PROM, EEPROM, RAM, DRAM, flash and other such memory devices. In an embodiment, memory 116 comprises an EEPROM storing configuration information. Memory 116 is communicatively coupled to processor 112.

Power regulation circuitry 118 regulates and conditions power for use by the various electrical components and circuits of wireless interface device 104, including processor 112. Power regulation circuitry 118 may be communicatively coupled to power port 120. Power port 120 facilitates connection of wireless interface device 104 to an external source of power. In one such embodiment, power port 120 comprises a mini USB port. In other embodiments, wireless interface device 104 may include an internal power source, such as batteries.

Communications module 122 is communicatively coupled to processor 112, and in an embodiment comprises a wireless communications module. In an embodiment, communications module 122 comprises a transceiver with an antenna, configured to communicate over a variety of networks using a variety of communication protocols and technology. Communications module 122 may be configured to communicate wirelessly using WiFi, Bluetooth, Z-Wave, Zigbee, cellular, or other radio-frequency-based technologies.

"Computer" 106 may comprise any of a variety of computing devices configured to communicate with wireless interface devices or other sending/transmitting units, including stationary and mobile computers, including notebook computers, tablets, smartphones, and so on. Computer 106 generally comprises hardware and software as understood by those skilled in the art, including processors, data ports, communication modules, and so on. As the recipient of musical sound control data formatted according the ZR-WP protocol of the invention, computer 106 may also include a translator application configured to receive data in a first format and translate the data into a second format understood by a user application of computer 106.

In general operation, controller 102 generates musical sound control data according to a first protocol or format and transmits the data to wireless interface device 104 over first network 108. In an embodiment, controller 102 comprises a MIDI controller, and streamed data comprises MIDI data. Wireless interface device 104 receives musical sound control data in the first format, packetizes the received data into payload packets according to a second protocol, which includes the ZR-WP protocol, for transmission over second network 110, which may be a wireless network. Computer 106 receives the data from wireless interface device 104, and periodically sends an acknowledgment message indicating which data packets have been received. The operation of system 100, and the ZR-WP protocol will be described in further detail below with respect to FIGS. 7-13.

Figure 3:
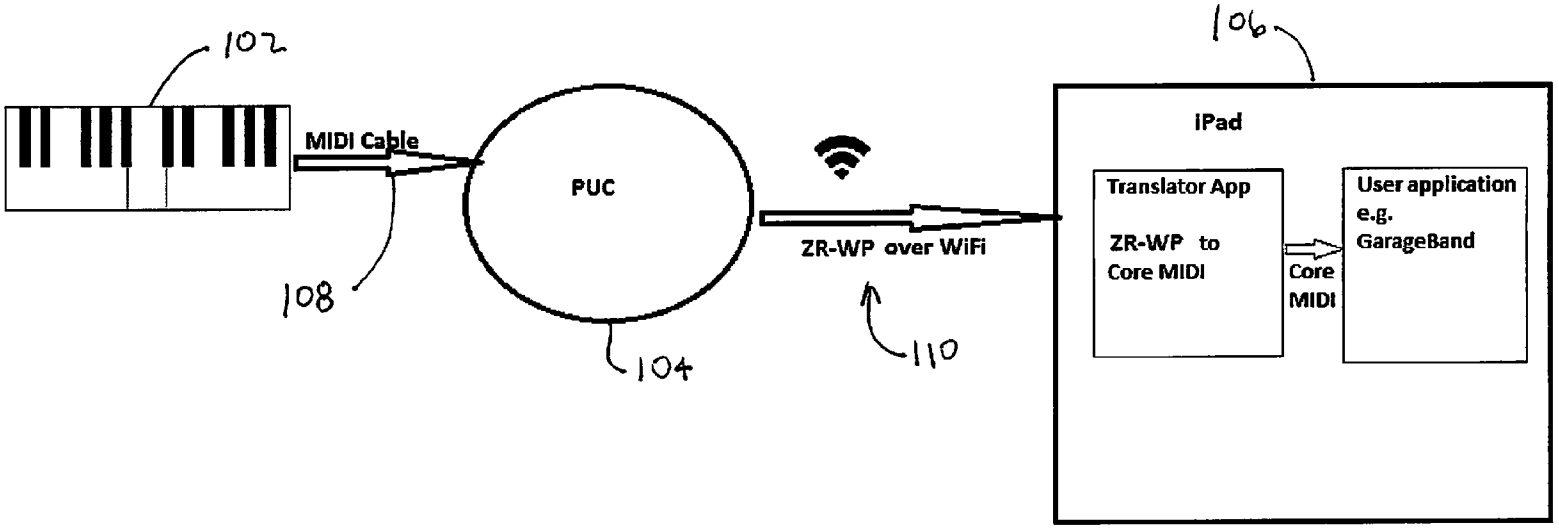
FIG. 3 is a block diagram of a musical sound control data communications system that includes a MIDI controller cabled to a wireless interface device communicating over a wireless network to a tablet computer, according to an embodiment of the system of FIG. 1.

Referring to FIG. 3, an embodiment of musical sound control data communications system 100 is depicted. In this embodiment, controller 102 comprises a MIDI keyboard transmitting MIDI data over a MIDI cable to wireless interface device 104. In this embodiment, wireless interface device 104 comprises a "PUC" device configured to communicate with MIDI controllers over a MIDI cable. Wireless interface device 104 reformats the received MIDI commands to the second format, ZR-WP, and transmits the ZR-WP wirelessly over Wi-Fi network 110 to computer 106. In the depicted embodiment, computer 106 comprises a tablet computer, such as an Apple® iPad® running an operating system iOS. ZR-WP data is translated to core-MIDI for use by an application on the iPad, which may be a music workstation application such as GarageBand for iOS.

Figure 4:
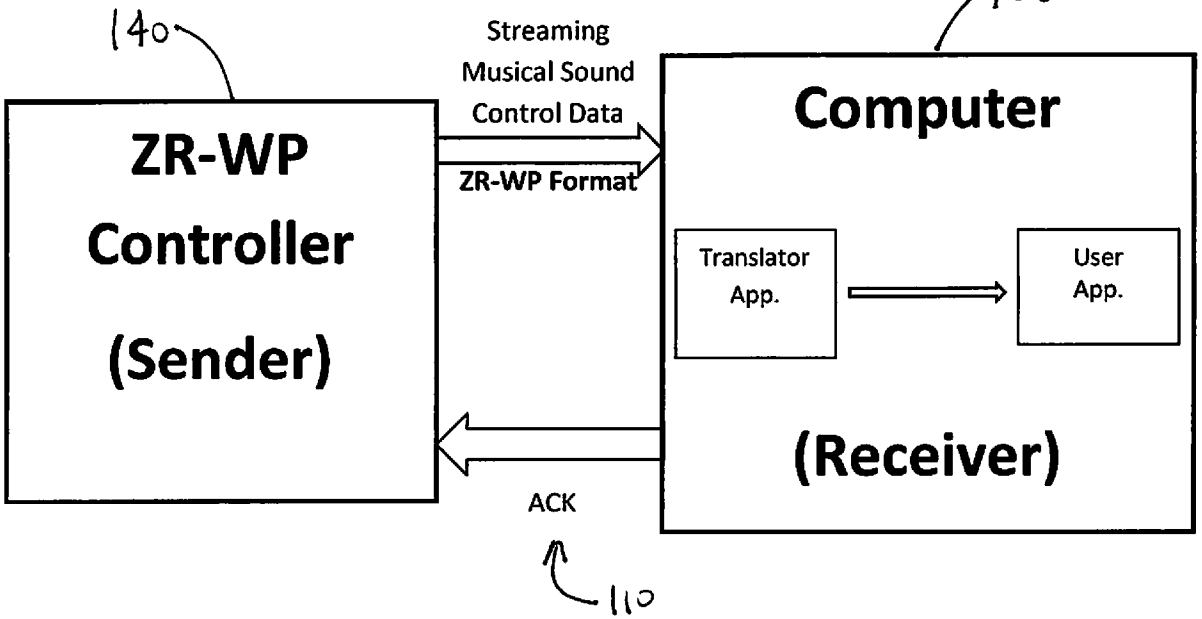
FIG. 4 is a block diagram of a musical sound control data communications system, according to an embodiment of the invention.

Referring to FIG. 4, an alternate embodiment of musical sound control data communications system 100 is depicted. In this embodiment, wireless interface device 104 is not required. In this embodiment, musical sound control data is generated and formatted natively or directly into a ZR-WP format. Consequently, this embodiment of communications system 100 includes ZR-WP controller 140 communicating wirelessly over network 110 to computer 106.

Figure 5:
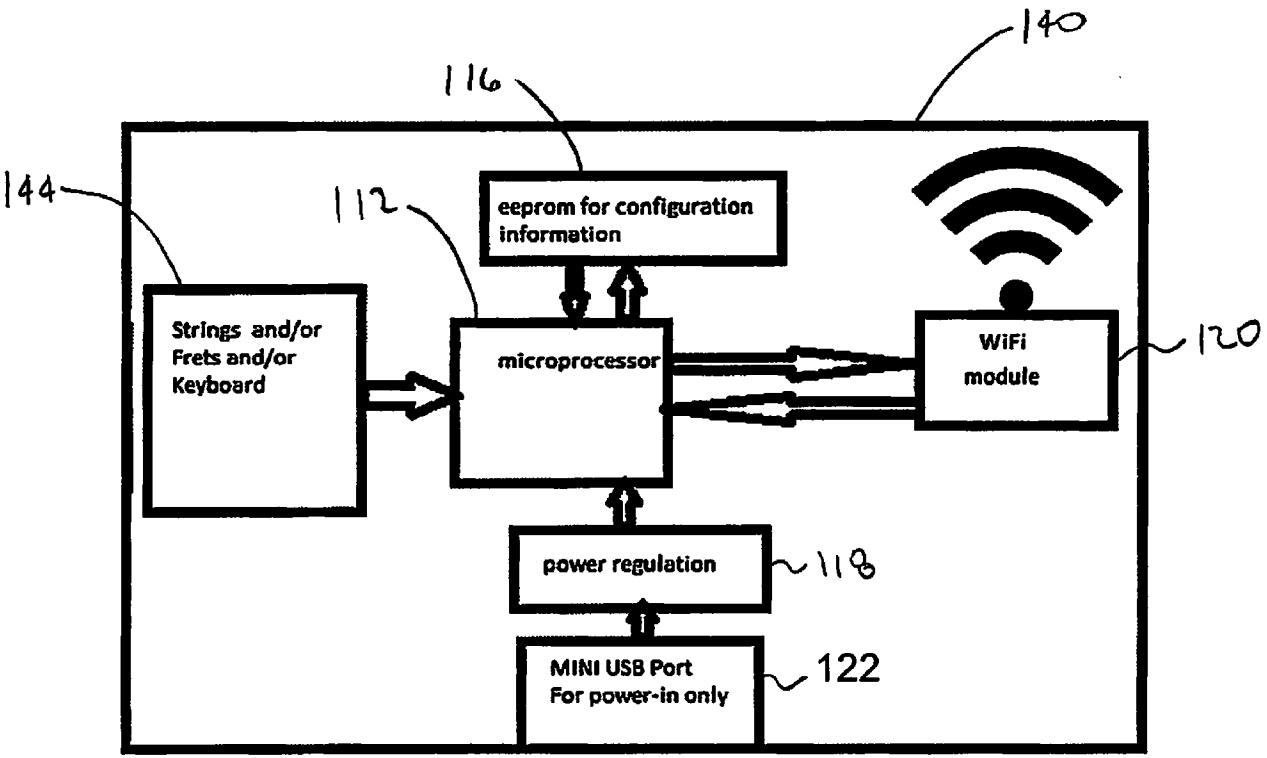
FIG. 5 is a block diagram of a musical sound control data communications system that includes a ZR-WP controller communicating over a wireless network to a tablet computer, according to an embodiment of the system of FIG. 4.

Referring to FIG. 5, an embodiment of ZR-WP controller 140 is depicted. In this embodiment, ZR-WP controller 140 shares many physical and functional attributes of wireless interface device 104. In the depicted embodiment, ZR-WP controller 140 includes processor 112, input portion 144, memory 116, power regulation circuitry 118, optional power port 120, and communications module 122.

Input device 144 serves as an interface to the musician, or user, of ZR-WP controller 140, and in an embodiment, comprises a keyboard, strings, frets, wind instrument, synthesizer, drum, and other such musical interfaces.

In general operation, a musician "inputs" or creates musical notes by selectively engaging input portion 144, such as by pushing keys of a keyboard, or pressing frets of a guitar or plucking strings of a stringed instrument. Engagement of input portion 144 generates electronic signals transmitted to processor 112, which generates MIDI payload data for inclusion in ZR-WP-formatted data packets to be transmitted by communications module 122.

Figure 6:
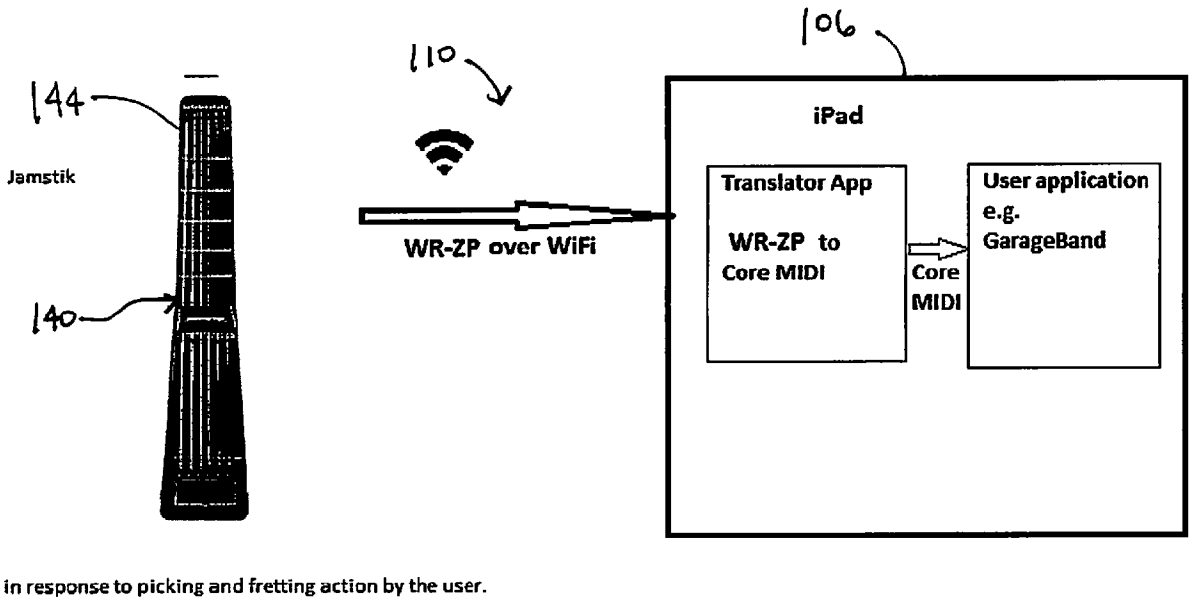
FIG. 6 is a block diagram of the ZR-WP controller of FIG. 5, according to an embodiment of the invention.

Referring to FIG. 6, an embodiment of musical sound control data communications system 100 is depicted. In this embodiment, ZR-WP controller 140 comprises a Jamstik™ controller as designed by Zivix LLC, Minneapolis, Minn., assignee of the present application. Jamstik 144 includes input portion 144 comprising frets and strings, and generates ZR-WP data for wireless transmission over network 110 to computer 106. Similar to the embodiment of system 100 depicted and described with respect to FIG. 3, computer 106 as depicted comprises an Apple iPad that includes a translator application and user application.

As briefly described above, embodiments of the invention also include methods of communicating musical sound control data using a unique communications messaging protocol. Embodiments of the methods and protocol are described in detail below with respect to FIGS. 7-14.

Figures 7, 8, 9:
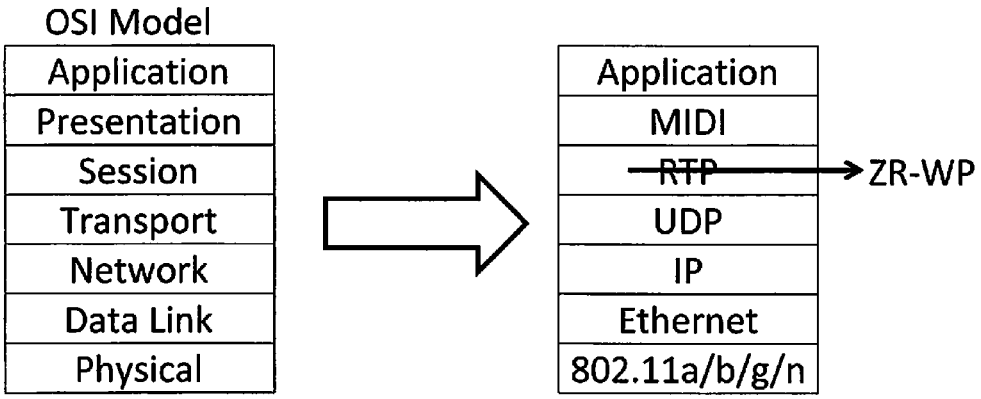
FIG. 7 is a diagram illustrating network features of the systems of FIGS. 1-6 using the OSI conceptual model.
FIG. 8 is a block diagram depicting a data packet format, according to an embodiment of the invention.
FIG. 9 is a block diagram depicting a main packet header format of the data packet of FIG. 8, according to an embodiment of the invention.

Referring to FIG. 7, the Open Systems Interconnection (OSI) model provides a conceptual framework for characterizing the transmission of data over a communications network. The seven different functional layers provide a means for describing communication in terms of logical layers. As described briefly above, known networks for transporting or transmitting MIDI data may utilize RTP-MIDI technology. An RTP payload format for MIDI commands is described in a standard adopted by the Internet Engineering Task Force (IEFT), Request for Comments: 6285-RTP Payload Format for MIDI, J. Lazzaro, J Warzynek, published June 2001, which is herein incorporated by reference in its entirety.

The RTP-MIDI protocol utilizes the generic protocol for real-time applications, Real-Time Protocol (RTP), to transport MIDI data over connectionless-oriented networks, such as UDP/IP networks. Rather than relying solely on retransmission to augment missing data packets at a receiver, the RTP-MIDI protocol utilizes a system of recovery journals to transmit data packet state information, along with real-time MIDI command data, allowing lost data packets to be reconstructed at the receiver as needed.

Conforming a typical RTP-MIDI application to the OSI Model yields a network layer as depicted in FIG. 7. As depicted, transport of MIDI over a wireless network may be accomplished using the RTP protocol over a UDP/IP network.

Embodiments of the ZR-WP communications system of the invention described herein also use an RTP payload format for transporting MIDI commands over a UDP/IP network. However, the ZR-WP protocol or format differs from the RTP MIDI protocol in a number of ways that will become evident based on the description below. These differences produce reduced latency and jitter, resulting in improved sound production, particularly during live performances.

Embodiments of the ZR-WP real-time wireless communication system 100, including methods of implementing the protocol, provide many features and benefits over known systems for transmitting MIDI messages.

Referring to FIGS. 8-12, data packet formats of the ZR-WP communications system and protocol are depicted.

Referring specifically to FIG. 8, in an embodiment, each ZR-WP data packet will comprise a main header followed by a command-specific payload. In an embodiment, the main header may comprise a 4-byte header, while the command-specific payload comprises a variable length of n bytes.

Referring also to FIG. 9, in an embodiment, the main header may comprise a 'z', or another identifying character, to identify the packet as a packet formatted according to the ZR-WP protocol, followed by a command number, which in an embodiment comprises a single byte, and ending with a feedback sequence number. In an embodiment, the feedback sequence number for packets generated and transmitted by the sender, the feedback sequence number may always be sent to 0000 for reasons explained further below. For packets sent by the receiver in the form of an acknowledgement message or ACK, the feedback sequence number of the main header of the receiver-sent ZR-WP packet will be set to the highest number packet sequence number of the received ZR-WP packet. In an embodiment, a feedback sequence number may be a 16-bit number (big endian) and used to acknowledge receipt of data by a receiver, as will be described further below (see also FIGS. 1 and 4 depicting a receiver/computer 106 returning an ACK message).

The command constants in the main header identify the type of command being transmitted. Table 1 below provides a non-exhaustive listing of some command constants:

TABLE 1

| Constant | Command |
|---|---|
| 0x00 | NOP/Reserved |
| 0x01 | MIDI Payload |
| 0x02 | Feedback |
| 0x03 | Ping |
| 0x04 | Ping Response |
| 0x05 | Device Available |
| 0x06 | Connect |
| 0x07 | Disconnect |

Embodiments of the commands of Table 1 are described below:

0x01 MIDI Payload

Details of the MIDI Payload command are described further below with respect to FIGS. 11 and 12.

0x02 Panic

When the receiver, computer 106, sees this command it should turn all notes off. In an embodiment, there is no additional payload associated with this command. In an embodiment, this command is not acknowledged, so it is not guaranteed to be handled.

0x03 Ping

When the receiver sees this command, it should change the command to a 0x04 and then echo what was received back to the sender. This command is used for diagnostic purposes, and may not be cleared or guaranteed to be received.

0x04 Ping Response

This command is also used for diagnostic purposes.

0x05 Device Available

FIG. 10 depicts a format for an embodiment of a Device Available command.

0x06 Connect/Reset

Since the ZR-WP protocol is based on UDP, there isn't a "connection" in the TCP sense. However, it can be necessary to send this command to reset the sequence numbers to respectable values. For example, a receiver might be waiting for a sequence, such as 15,439 but the sender might have reset itself to sequence 0. This would cause the receiver to be forced to wait for 15,439 packets before it started actually processing MIDI commands.

8.7 0x07 Disconnect

This command is sent to indicate that no further data is desired.

Referring to FIG. 11, an overview of a format for a command-specific ZR-WP payload packet, according to an embodiment, and corresponding to command constant 0x01, is depicted.

Each ZR-WP payload packet comprises a main payload-packet header, optionally followed by a list of historical payloads, or historical payload sub-packets. "Historical Payload" can refer to payload data that has been previously transmitted (non-current), or can refer to new/current data that has not yet been transmitted. In some instances, the historical payload may include only the most current data to be sent, typically, a single packet. In other instances, such as in a "keep-alive" packet (explained further below), the historical payload may only include data previously-transmitted. In other instances, the historical payload includes a series of payloads that includes multiple sub-packets of previously-sent historical payloads as well as a current historical payload.

In the embodiment depicted, Historical Payload 0 comprises the oldest, unacknowledged payload, Historical Payload 1 comprises the next oldest unacknowledged payload, and so on, up to historical payload n, which is the most recent or current payload. Generally, the packet order is structured such that the oldest historical payloads are streamed in an order from oldest to newest, though in other embodiments, any order is possible. The number of bytes per Historical Payload is "n", meaning that the number of bytes is variable, and may vary from Historical Payload to Historical Payload.

As will be described further below, "unacknowledged" payloads refer to payloads that have not been confirmed as received by the receiver. Acknowledged payloads are those that have been acknowledged by the receiver, as verified by receipt of an ACK message at the sender.

As depicted, in an embodiment, the ZR-WP payload packet header includes the "z" (indicated by "0x7A)"), followed by a command constant indicating that the packet payload is a MIDI payload (0x01 in this embodiment), followed by a feedback sequence number. In an embodiment, the payload packet header comprises 32 bits.

Referring also to FIG. 12, an embodiment of a format for an individual Historical Payload (sub-packet) is depicted. In the depicted embodiment, each Historical Payload includes a header comprising a packet sequence number originally assigned to the historical payload and a length, such that the header is 3 bytes. In an embodiment, the payload packet sequence number of a new Historical Payload packet is assigned based on a transmission sequence number which is updated by the sender. The assignment and functioning of packet sequence numbers will be described further below in an example, and with respect to the flow diagrams of FIGS. 13 and 14.

In other embodiments, the header may comprise more or fewer bytes. In an embodiment, the "length" does not include the length of the header itself.

The header of the Historical Payload is followed by the historical data, or raw MIDI data, depicted as "Data . . . n . . . " The amount of data in the Historical Payload depends on the characteristics of the raw MIDI data, such as the number of MIDI commands and their content.

Figure 13:
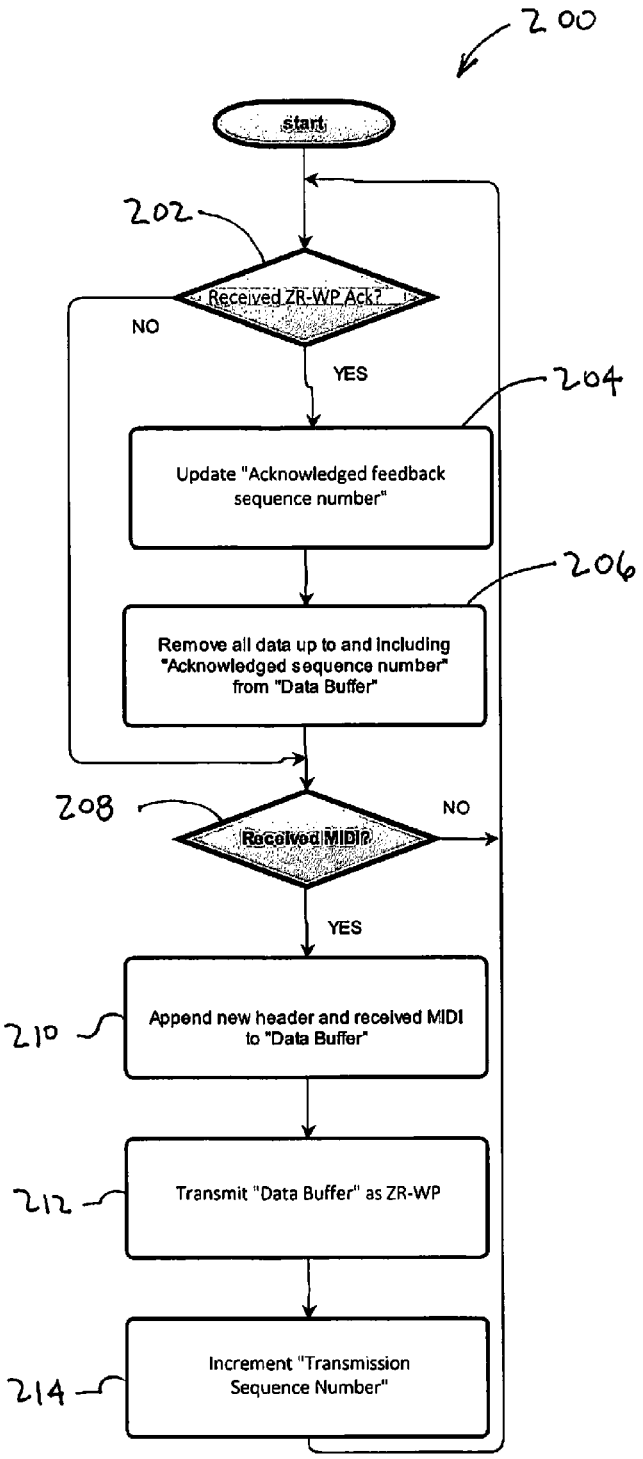
FIG. 13 is a flow diagram of a method of transmitting data packets, according to an embodiment of the invention.

Referring to FIG. 13, a flow diagram depicting and describing a process of preparing, logging, and transmitting ZR-WP data packets is provided.

As will be described in further detail with respect to the flow diagram of FIG. 13, generally, and in an embodiment, all transmission data, ZR-WP packets, should be held in a FIFO (first in first out) transmission log (TX Fifo Log or TX Log), or data buffer. Essentially the entire contents of the TX Log will be transmitted with every ZR-WP packet. As packets to be transmitted are added, the TX Log will grow and continue to grow until an acknowledgment message/packet (ACK) is received from the target computer 106.

As will be described further with respect to FIG. 13, computer or receiver 106 continually analyzes incoming packet sequence numbers, determines the highest packet sequence number of the received packet, sets it as the Feedback Sequence Number, and then transmits the ACK containing that greatest or "highest" sequence number, now considered the Feedback Sequence Number, back to the sender 104/140. The Feedback Sequence Number of the ACK when received at the sender is compared to a previously-received Feedback Sequence Number at the sender (the Acknowledged Feedback Sequence Number), and if greater in value, the newly-received Feedback Sequence Number of the ACK replaces the earlier Acknowledged Feedback Sequence Number as the current Acknowledged Feedback Sequence Number.

In an embodiment, each time an ACK packet is received an acknowledgement procedure will be run to clear any and all packets from the TX Log that include packet sequence numbers that are less than or equal to the received/updated Feedback Sequence Number. In this manner the TX Log is trimmed following the receipt of each acknowledgement message.

In an embodiment, if ACK feedback packets are received out of order, it will be inconsequential because the transmitting end will not increment the saved or Acknowledged Feedback Sequence Number unless the previous sequences were received.

With respect to evaluating whether to advance the "tail" of the transmission based on the transmission log sequence number (TXLogSeq), which is used to assign packet sequence numbers, and the Acknowledged Feedback Sequence Number (FBSeq), in an embodiment, the following logic may be used: If (TXLogSeq-FBSeq>0x8000) then consider the TXLogSeq to be greater than the FBSeq, even if it is not. In an embodiment utilizing a 32-bit processor, the TXLogSeq is simply copied into a 32-bit temporary variable and 0x10000 is added to it if the aforementioned condition is true. This prevents clearing logs prematurely when roll-over conditions occur.

With specific reference to FIG. 13, the above-described process 200 is depicted and described in a series of steps.

At step 202, sender 104/140 determines whether a ZR-WP ACK message has been received. If so, at step 204, the sender, such as wireless interface device 104 or controller 140 updates the Acknowledged Feedback Sequence Number. As described briefly above, the Acknowledged Feedback Sequence Number is the greatest or highest value feedback sequence number received in the ACK from computer/receiver 106.

At step 206, historical payloads having packet sequence numbers less than or equal to the Acknowledged Feedback Sequence Number are removed from the TX Log, or data buffer.

Referring again to step 202, if no ZR-WP ACK message is received, steps 204 and 206 are skipped.

At step 208, sender 104/140 determines whether new raw MIDI data has been received, as in the case of a wireless interface device 104, or whether new ZR-WP data has been generated, as in the case of a ZR-WP controller 140 generating native ZR-WP data.

If no new data has been received, the process reverts to step 202.

If new data has been received, then at step 210, a new historical payload is created. The new historical payload is created with a new historical payload header that includes a packet sequence number that is set according to the current transmission log sequence number, and the payload is added to the data buffer or TXLog.

At step 212, the contents of the data buffer, i.e., a new ZR-WP packet, is transmitted.

At step 214, the Transmission Sequence Number at the sender is incremented, and the process reverts to step 202 again.

Figure 14:
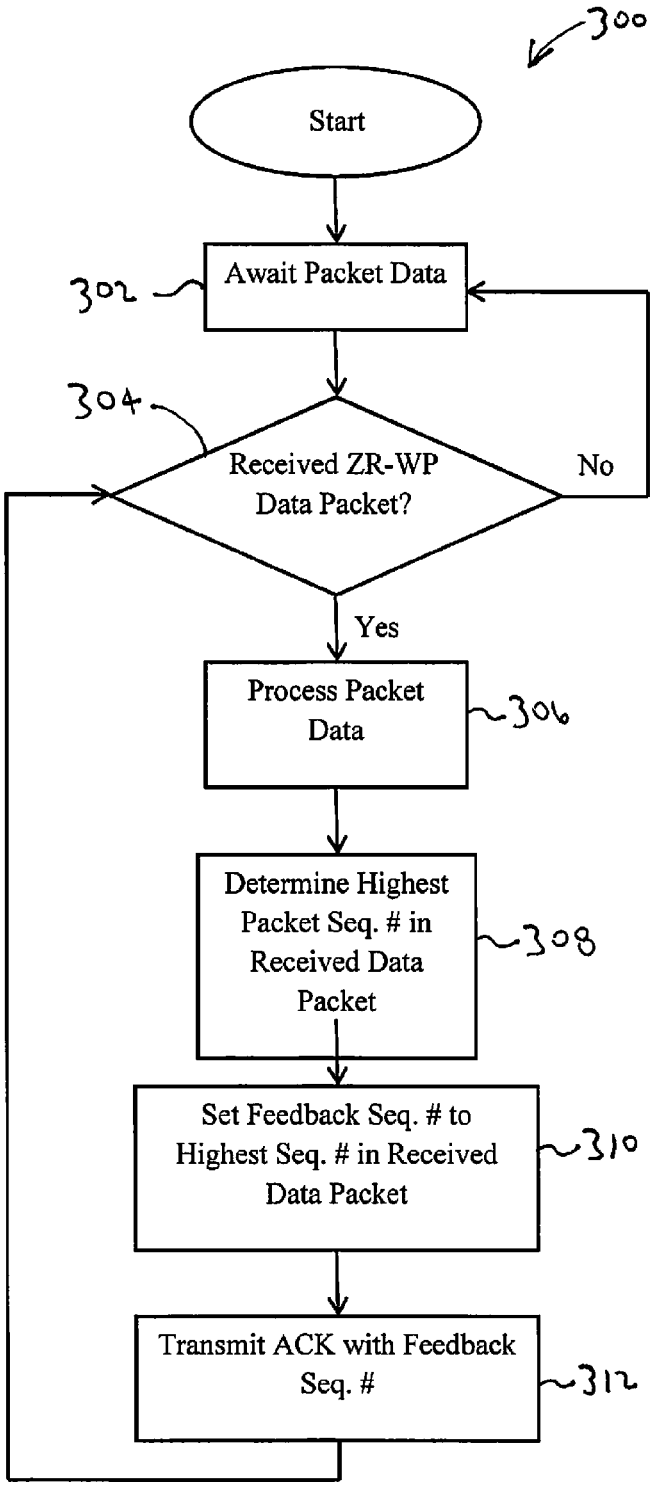
FIG. 14 is a flow diagram of a method of receiving data packets, according to an embodiment of the invention.

Referring to FIG. 14, a process 300 performed by computer 106, or the receiver of the ZR-WP data packets, is depicted and described in a flow diagram.

At step 302, computer 106 awaits a data packet; at step 304, computer 106 determines whether a ZR-WP data packet is received, and if so, at step 306, the data packet is processed.

At step 308, computer 106 and its processor determine the highest packet sequence number of the received packet. In an embodiment, each of the Historical Payload packets is analyzed to determine the highest sequence number of the transmitted Historical Payload packets.

At step 310, the internal Feedback Sequence Number of the receiver is set to the highest sequence number in the received packet.

At step 312, an acknowledgement message that includes the newly-updated Feedback Sequence Number is transmitted to the sender, and the process reverts to step 304.

Generally, as described above, upon receiving a ZR-WP packet, the receiver will always process the packet and set its internal feedback sequence number to the highest sequence number available in the packet and transmit it as an ACK back to the sender. The ACK transmission should occur quickly so that the sender's buffer will not overflow. In an embodiment, the ACK is transmitted even before the received MIDI data is processed. In an embodiment, ACK messages are sent frequently enough such that the sender's buffer rarely if ever fills up past 50%. In other embodiments, the data buffer may be filled to a maximum ranging from 25% to 75%. In other embodiments, the data buffer may be filled to 100% capacity.

In an embodiment, if a packet's first Historical Payload packet sequence number is higher than an expected packet sequence number of the receiver, the receiver will have no choice but to accept and process the packet, although in this situation, data loss has likely occurred (unless this is the first packet). In an embodiment, there may be no mechanism to recover data older than the first sequence in the historical payload such that packet loss is accepted and the communications process continues despite the accepted loss.

As is evident from the above description, the generation and transmission of data packets that include previously-transmitted, but not-yet-acknowledged MIDI commands creates a sort of data-redundant transmission scheme that differs significantly from known protocols, including RTP MIDI. Rather than include actual previously-transmitted MIDI commands embedded in the data packet, the RTP-MIDI protocol sends state data that can be used by a receiver to reconstruct lost data packets. While the RTP-MIDI protocol may include some advantages in terms of bandwidth savings, sound quality suffers as a result of periodic, unacceptable latency due to time spent rebuilding lost data based on the state data of previous data transmitted to the receiver along with current data.

In one known variation of a standard RTP-MIDI protocol proposed by Falquet and Fober in the article "RTP MIDI: Recovery Journal Evaluation and Alternative Proposal" published by the Laboratoire De Recherche En Informatique Musicale as Technical Report TR-050622 in June, 2005, a recovery journal system is proposed that includes some redundant data. However, the recovery journal system of Falquet relies upon providing a fixed number of redundant notes in each payload, and then having the receiver determine whether to request missing notes.

In contrast, systems, methods and protocols of the invention as described herein are designed to optimize real-time performance by minimizing latency and jitter, and such systems, in embodiments, thereby avoid the detrimental step of having the receiver request missing packets. Rather, embodiments of the invention continue to transmit unacknowledged data, without a fixed, or predetermined number of redundant data notes in each payload, and without the overhead of receiver requests for missing data, thereby minimizing latency and jitter.

In an embodiment, and unlike known schemes, packet sizes are not restricted, and may grow to reach the maximum as large as, or even larger than, the maximum transmission unit allowed by the communications protocol. As described above, communications system 100, including the ZR-WP protocol may be implemented over a wireless network, such as Wi-Fi. In contrast to the transport layer ZR-WP protocol, the 802.11 protocol, defines that transmitted packets be retried under circumstances where collisions are detected. These retransmissions are particularly expensive and frequent on wireless networks. For this reason, when the hardware permits it, the ZR-WP protocol may transmit packets over ad-hoc networks to a unicast IP address e.g., 192.168.17.20 but using a broadcast MAC address FF:FF:

FF:FF:FF:FF. Doing this causes the 802.11 protocol to drop collided packets immediately as opposed to retrying them. This, when used hand-in-hand with aggressive keep-alive timers, as described below, will facilitate the fastest and most real-time error recovery possible over Wi-Fi.

In an embodiment of the invention, a "keep-alive timer" scheme may be implemented. "Keep-alive" data packets serve at least two purposes. The first is to ensure that all ZR-WP payload data reaches the receiver without delay, and second to keep computer 106 in a constant processing mode so as to avoid introducing additional, unnecessary receiver-induced latency. Without these packets, a receiver may try and save battery life by powering down the Wi-Fi receiver. This adds latency when powering the Wi-Fi receiver back up. In this scheme minimizing latency is paramount. Keep-alive data packets are sent at predetermined intervals as needed. In order to achieve the fastest recovery time for lost or dropped packets, the keep-alive timer may be used in an aggressive manner when there are uncleared historical payloads (non-current payloads) in the transmission log, TX Log. Keep-alive packets are essentially payload packets. In an embodiment, the keep-alive packets contain all pending, historical payloads, and comprise a retransmission of all uncleared data.

In an embodiment, keep-alive data packets are distinguished from, or could be considered a subset of, "regular" ZR-WP data packets in that they do not include current data, and thus comprise only historical data. As described further below, although keep-alive timers may include historical, unacknowledged data in pursuit of the purpose of ensuring data is received, some keep-alive packets may comprise "empty" payloads in pursuit of the second purpose of solely keeping the receiver alert or "alive."

When there are pending historical payloads, the keep-alive timer should behave particularly aggressively. In an embodiment, a keep-alive interval of <20 ms is preferable when on ad-hoc networks capable of using broadcast-mac/unicast-ip (BM/UIP). When there are no uncleared/unacknowledged historical payloads outgoing, the keep-alive timer interval may be dialed back slightly based on characteristics of computer 106. For example, for certain computers 106, if the antenna is unused for too great of a time period, additional latency is added due to receiver operation. In an embodiment, a tablet computer, such as an iPad device performs better if the antenna is not unused for more than 100 ms. As such, in an embodiment, a keep-alive timer of approximately 75 ms when no historical payloads may be used when there are unacknowledged to ensure that there is no delay in reception when MIDI-data is momentarily silent. In an embodiment, keep-alive packets transmitted when there are no unacknowledged historical payloads may include empty payloads, i.e., contain no command data.

In some embodiments, the ZR-WP protocol is adapted to be used with Wi-Fi Direct which allows a device to talk to ad-hoc connections simultaneously with infrastructure networks. The ZR-WP protocol is designed to be wrapped in a Wi-iI direct layer.

To solidify understanding of communications system 100, its apparatuses, methods, and protocol, an example transmission sequence is described below with respect to FIGS. 1-3.

In this example, a wireless interface device 104, such as a PUC, is designed to receive conventional MIDI messages over a wired network 108, such as a MIDI cable and to retransmit the MIDI messages using ZR-WP over Wi-Fi. For example, a PUC might connect to MIDI controller 102, which may be an electronic keyboard, and send MIDI to a user application on a computer 106, which may be iPad, allowing the user to play music on the iPad. In this example, low latency is essential to a good user experience.

Figure 15:
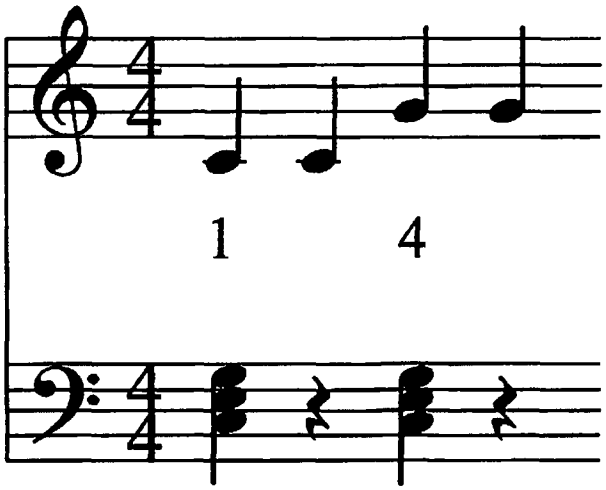
FIG. 15 is a diagram of a sequence of notes that can be played on a keyboard.

Suppose firstly that the keyboard is used to play the sequence of notes depicted in FIG. 15.

In MIDI the sequence of notes might be expressed as:

1. Four "note-on" MIDI commands, playing the notes C4,C3,E3,G3: 0x90,0x3C,0x7F,0x90,0x30,0x7F,0x90,0x34,0x7F,0x90,0x37,0x7F, followed by:
2. Four note-off commands, releasing the keys C4,C3,E3,G3: 0x80,0x3C,0x00,0x80,0x30,0x00,0x80,0x34,0x00,0x80,0x37,0x00, followed by:
3. One note-on command, playing the note C4: 0x90,0x3C,0x7F, followed by:
4. One note-off command, releasing the key C4: 0x80,0x3C,0x00, followed by:
5. Four note-on commands, playing the notes G4,C3,E3,G3: 0x90,0x43,0x7F,0x90,0x30,0x7F,0x90,0x34,0x7F,0x90,0x37,0x7F, followed by:
6. Four note-off commands, releasing the keys G4,C3,E3,G3: 0x80,0x43,0x00,0x80,0x30,0x00,0x80,0x34,0x00,0x80,0x37,0x00, followed by:
7. One note-on command, playing the note G4: 0x90,0x43,0x7F, followed by:
8. One note-off command, releasing the key G4: 0x80,0x43,0x00

In ZR-WP, the above MIDI commands would be formatted and sent as a series of ZR-WP packets as follows:

Packet 1 Transmitted from the Sender/PUC (Wireless Interface Device 104 or Controller 140):

TABLE 2

| | |
|---|---|
| 0x7A,0x01,0x00,0x00 | Main packet header: 'z', command=payload, Feedback Sequence Number 0000 |
| 0x00,0x00,0x0C, | Payload Packet Header: Sequence 0000, Length 12 (0x0C) |
| 0x90,0x3C,0x7F,0x90, 0x30,0x7F,0x90,0x34, 0x7F,0x90,0x37,0x7F | Historical payload 0 (current data/payload): 12 Midi bytes representing 4 Note-On commands |

Acknowledgement from the Receiver/iPad (Computer 106)

In this example, it is assumed that no acknowledgement was received from computer 106.

Packet 2 Transmitted from the Wireless Interface Device (Table 3).

If no acknowledgement from computer 106 has been received, then the sender needs to send the four new note-off commands, as well as the historical data of Packet 1. At this point, the previously-transmitted payload of Packet 1, "Historical Payload 0", becomes "historical" in that it was previously transmitted, while Historical Payload 1 is the most current, or new payload data. A header for Historical Payload 1 is created by assigning a sequence number to the new data, and the Historical Payload 1 sub-packet is added to the transmission log/buffer, and the buffer contents transmitted to the receiver. Note that in this embodiment, the main packet header for the ZR-WP packet generated by the sender keeps the feedback sequence number set to 0000.

TABLE 3

| | |
|---|---|
| 0x7A,0x01,0x00,0x00 | Main packet header: z, payload, Feedback Sequence Number (FBS) 0000 |
| 0x00,0x00,0x0C, | Payload Packet Header: Sequence 0000, Length 12 (0x0C) |
| 0x90,0x3C,0x7F,0x90,0x30,0x7F, | Historical Payload 0: 12 Midi bytes |

TABLE 3-continued

| | |
|---|---|
| 0x90,0x34,0x7F,0x90,0x37,0x7F | representing 4 Note-on |
| 0x00,0x01,0x0C, | Payload Packet Header: Sequence 0001, Length 12 (0x0C) |
| 0x80,0x3C,0x00,0x80,0x30, 0x00,0x80,0x34,0x00,0x80, 0x37,0x00 | Historical Payload 1: 12 Midi bytes representing 4 Note-off |

Acknowledgement from the Receiver

Assume now that an acknowledgement message is received from the receiver, the acknowledgement packet (ACK) having the following format and data is depicted in Table 4:

TABLE 4

| | |
|---|---|
| 0x7A,0x01,0x00,0x01 | Main packet header, acknowledging receipt of sequence 0001 (z, payload command, FBS 0001) |

This acknowledges that a packet having a packet sequence number 0001 was received, as evidenced by the Feedback Sequence Number of 0001, and by implication everything prior.

Packet 3 from the PUC

Because sequence 0001 has been acknowledged, the sender does not need to send historical payload data corresponding to packet sequence number 0001 (Historical Payload 1), or historical payload data corresponding to packet sequence number 0000 (Historical Payload 0), but rather only needs to send the new, current Historical Payload data, as described in Table 5:

TABLE 5

| | |
|---|---|
| 0x7A,0x01,0x00,0x00 | Main packet header (z, payload, FBS# 0000) |
| 0x00,0x02,0x03, | Sequence 0002, Length 3 (0x03) |
| 0x90,0x3C,0x7F | 3 Midi bytes representing 1 Note-on |

Acknowledgement from the iPad

Say now that an acknowledgement message as described in Table 6 is received from the iPad:

TABLE 6

| | |
|---|---|
| 0x7A,0x01,0x00,0x02 | Main packet header, acknowledging sequence 0002 (z, payload, FBS# 0002) |

This acknowledges packet sequence number 0002 was received, and by implication everything prior.

Packet 4 from the PUC

Because sequence 0002 has been acknowledged, the sender does not need to send historical payload data corresponding to sequence number 0002, or any earlier historical payloads, but rather only needs to send the new, current payload data, Historical Payload 3, as described in Table 6:

TABLE 7

| | |
|---|---|
| 0x7A,0x01,0x00,0x00 | Main packet header (z, payload, FBS# 0000) |
| 0x00,0x03,0x03, | Sequence 0003, Length 3 (0x03) |
| 0x80,0x3C,0x00 | 3 Midi bytes representing 1 Note-off |

Packet 5 from the PUC

Because no acknowledgement was received the sender/PUC needs to send the new sequence 0004, as well as some historical payload data, as described in Table 8:

TABLE 8

| | |
|---|---|
| 0x7A,0x01,0x00,0x00 | Main packet header |
| 0x00,0x03,0x03, | Sequence 0003, Length 3 (0x03) |
| 0x80,0x3C,0x00 | 3 Midi bytes representing 1 Note-off |
| 0x00,0x04,0x0C, | Sequence 0004, Length 12 (0x0C) |
| 0x90,0x43,0x7F,0x90,0x30, 0x7F,0x90,0x34,0x7F,0x90, 0x37,0x7F | 12 Midi bytes representing 4 Note-ons |

Packet 6 from the PUC

Because no acknowledgement was received the sender needs to send the new sequence 0005, as well as the historical data remaining in the buffer, as described in Table 9:

TABLE 9

| | |
|---|---|
| 0x7A,0x01,0x00,0x00 | Main packet header |
| 0x00,0x03,0x03, | Sequence 0003, Length 3 (0x03) |
| 0x80,0x3C,0x00 | 3 Midi bytes representing 1 Note-off |
| 0x00,0x04,0x0C, | Sequence 0004, Length 12 (0x0C) |
| 0x90,0x43,0x7F,0x90,0x30,0x7F, 0x90,0x34,0x7F,0x90,0x37,0x7F | 12 Midi bytes representing 4 Note-ons |
| 0x00,0x05,0x0C, | Sequence 0005, Length 12 (0x0C) |
| 0x80,0x43,0x00,0x80,0x30,0x00, 0x80,0x34,0x00,0x80,0x37,0x00 | 12 Midi bytes representing 4 Note-offs |

Acknowledgement from the iPad

Say now an acknowledgement from the iPad for packet 5 is received as described in Table 10:

TABLE 10

| | |
|---|---|
| 0x7A,0x01,0x00,0x04 | Main packet header, acknowledging sequence 0004 |

This acknowledged sequence 0004 as received, and by implication everything prior.

Packet 7 from the Wireless Interface Device

Because an acknowledgement was received for sequence 0004, the wireless interface device 106 needs to send historical sequence 0005 as well as the new data, as described in Table 11:

TABLE 11

| | |
|---|---|
| 0x7A,0x01,0x00,0x00 | Main packet header |
| 0x00,0x05,0x0C, | Sequence 0005, Length 12 (0x0C) |
| 0x80,0x43,0x00,0x80,0x30,0x00, 0x80,0x34,0x00,0x80,0x37,0x00 | 12 Midi bytes representing 4 Note-offs |
| 0x00,0x06,0x03, | Sequence 0006, Length 3 (0x03) |
| 0x90,0x43,0x7F | 3 Midi bytes representing 1 note-on |

Acknowledgement from the iPad

Say now we get an acknowledgement from the iPad, for our packet 7, as described in Table 12:

TABLE 12

| | |
|---|---|
| 0x7A,0x01,0x00,0x06 | Main packet header, acknowledging sequence 0006 |

This acknowledged sequence 0006 as received, and by implication everything prior.

Packet 8 from the PUC

Because an acknowledgement was received for sequence 0006, only the new data needs to be sent, as depicted in Table 13:

TABLE 13

| | |
|---|---|
| 0x7A,0x01,0x00,0x00 | Main packet header |
| 0x00,0x07,0x03, | Sequence 0007, Length 3 (0x03) |
| 0x80,0x43,0x00 | 3 Midi bytes representing 1 note-off |

Consequently, the present invention includes various embodiments of communication systems, apparatuses and methods, including implementations of unique communications protocols, for vastly improving the transmission of real-time musical sound control data, and in particular, MIDI data.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. A method of communicating musical sound control data over a wireless network, comprising:

receiving a data stream comprising a plurality of data commands formatted according to a MIDI protocol;

assigning a packet sequence number to each of the plurality of data commands to form a plurality of historical data payload packets;

storing the plurality of historical data payload packets in a buffer;

receiving at a wireless interface device an acknowledgment message having a feedback sequence number;

removing from the buffer selected historical payload packets of the plurality of stored historical data payload packets, each of the selected historical data payload packets having a packet sequence number that is the same as or less than the feedback sequence number, such that the buffer stores non-selected data commands, each of the non-selected data commands associated with a packet sequence number greater than the feedback sequence number; and transmitting the non-selected historical payload packets over a wireless network.

2. The method of claim 1, wherein the historical data payload packets include historical data payload packets that have previously been transmitted.

3. The method of claim 2, wherein the historical data payload packets include a historical data payload packet that has not yet been transmitted.

4. The method of claim 1, wherein a quantity of historical data payload packets is not predetermined.

5. The method of claim 1, wherein transmitting the non-selected historical payload packets over a wireless network comprises transmitting the non-selected historical payload packets to a receiver according to a user datagram protocol (UDP).

6. The method of claim 1, wherein the wireless network is an 802.11 compliant network.

7. The method of claim 1, further comprising receiving an acknowledgement message transmitted from a receiver, the acknowledgment message including a received feedback sequence number.

8. The method of claim 7, further comprising comparing the received feedback sequence number to a previous feedback sequence number, and when the received feedback sequence number is greater than or equal to the previous feedback sequence number, generate a new data packet that includes data not included in the other packets.

9. A method of communicating musical sound control data over a wireless network, comprising:

receiving a data stream at a wireless interface device, the data stream comprising a plurality of musical sound control commands formatted according to a first protocol, the plurality of musical sound control data including a first command, a second command and a third command;

generating a first musical sound control data packet formatted according to a second protocol, the data packet including a first main packet header and a first packet payload, the generation of the first musical sound control data packet including the steps of:

generating the first main packet header that includes a first feedback sequence number;

generating the first packet payload that includes the first musical sound control command;

transmitting the first musical sound control data packet over the wireless network;

generating a second musical sound control data packet formatted according to the second protocol and including a second main packet header and a second packet payload, the generation of the second musical sound control data packet including the steps of:

generating the second main packet header that includes a second feedback sequence number;

generating the second packet payload that includes the first musical sound control command and the second musical sound control command;

transmitting the second musical sound control data packet over the wireless network;

receiving an acknowledgement message transmitted from a receiver, the acknowledgment message including a received feedback sequence number; and comparing the received feedback sequence number to a previous feedback sequence number, and when the received feedback sequence number is greater than or equal to the previous feedback sequence number, generate a third musical sound control data packet that includes the third command, but does not include the first command and the second command.

10. The method of claim 9, further comprising when the received feedback sequence number is less than the previous feedback sequence number, generate a third musical sound control data packet that includes the first, second and third commands.

11. The method of claim 9, wherein the first protocol comprises a musical instrument digital interface (MIDI) protocol.

12. The method of claim 9, further comprising transmitting a plurality of keep-alive packets at predetermined time intervals.

13. The method of claim 12, wherein each keep-alive packet comprises previously-transmitted musical sound control data.

14. The method of claim 12, wherein a predetermined time interval is less than 20 ms.

15. The method of claim 12, wherein a predetermined time interval is less than 75 ms.

16. An interface device for transmitting musical sound control data over a wireless network, comprising:

a communications port configured to receive musical sound control data, the control data including a plurality of data commands formatted according to a musical instrument digital interface (MIDI) protocol;

a transceiver configured to receive an acknowledgment message having a feedback sequence number;

a memory configured to store data;

a processor in electrical communication with the transceiver and the memory, the processor configured to implement the steps of:

assigning a packet sequence number to each of the plurality of data commands to form a plurality of historical data payload packets;

causing the plurality of historical data payload packets to be stored in the memory;

removing from the memory selected historical payload packets of the plurality of stored historical data payload packets, each of the selected historical data payload packets having a packet sequence number that is the same as or less than the feedback sequence number, such that the memory stores non-selected data commands, each of the non-selected data commands associated with a packet sequence number greater than the feedback sequence number; and causing the transceiver to transmit the non-selected historical payload packets over a wireless network.

17. The interface device of claim 16, further comprising a MIDI controller.

18. The interface device of claim 16, wherein the processor is further configured to form a plurality of historical data payload packets without receiving a request for historical data payload packets from a receiver of the historical data payload packets.

19. The interface device of claim 16, wherein the interface device is embedded into a musical instrument.

20. The method of claim 16, wherein a quantity of historical data payload packets is not predetermined.

* * * * *